US009417605B2

(12) United States Patent
Takarada et al.

(10) Patent No.: US 9,417,605 B2
(45) Date of Patent: Aug. 16, 2016

(54) IMAGE FORMING APPARATUS AND PROCESS CARTRIDGE

(71) Applicant: CANON KABUSHIKI KAISHA, Tokyo (JP)

(72) Inventors: Hiroshi Takarada, Kawasaki (JP); Kuniaki Hirukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/801,670

(22) Filed: Jul. 16, 2015

(65) Prior Publication Data

US 2016/0018785 A1 Jan. 21, 2016

(30) Foreign Application Priority Data

Jul. 18, 2014 (JP) ..... 2014-148108

(51) Int. Cl.
*G03G 21/18* (2006.01)

(52) U.S. Cl.
CPC ..... *G03G 21/1867* (2013.01)

(58) Field of Classification Search
CPC G03G 15/80; G03G 21/1652; G03G 21/1871
See application file for complete search history.

(56) References Cited

U.S. PATENT DOCUMENTS

2013/0114972 A1* 5/2013 Takarada ..... G03G 15/80 399/110

FOREIGN PATENT DOCUMENTS

JP 2012-63750 A 3/2012

* cited by examiner

*Primary Examiner* — Gregory H Curran
(74) *Attorney, Agent, or Firm* — Canon USA, Inc., IP Division

(57) ABSTRACT

A cartridge attachable to and detachable from a main body of an image forming apparatus includes a process unit configured to perform image formation, a frame configured to support the process unit, and a conductive member injection-molded integrally with the frame using a conductive resin, configured contact with a main body electrode portion provided in the main body of the image forming apparatus, and to be electrically connected with the process unit, and a contact surface of the conductive member configured to contact with the main body electrode portion, includes a plurality of protruded portions.

16 Claims, 11 Drawing Sheets

IMAGE FORMING APPARATUS AND PROCESS CARTRIDGE

BACKGROUND OF THE INVENTION

1. Field of the Invention

The present invention relates to an image forming apparatus, and a cartridge attachable to and detachable from the image forming apparatus.

2. Description of the Related Art

The present invention relates to an electrophotographic image forming apparatus and a process cartridge (hereinafter, referred to as "cartridge") attachable to and detachable from the electrophotographic image forming apparatus. Herein, the electrophotographic image forming apparatus (hereinafter, referred to as "image forming apparatus") forms an image on a recording material (recording medium) using an electrophotographic image forming process. Examples of the image forming apparatus include a printer such as a laser beam printer, a light-emitting diode (LED) printer, and the like, a copying machine, a facsimile apparatus, a word processor, and a multifunction printer of the aforementioned devices.

Conventionally, in an image forming apparatus using an electrophotographic image forming process, a process cartridge system in which a cartridge is attachable to and detachable from a main body of the image forming apparatus has been employed. The process cartridge system can simplify maintenance of the image forming apparatus by forming an electrophotographic photosensitive drum (hereinafter, referred to as "photosensitive drum") and a process unit that acts on the photosensitive drum, integrally into a cartridge.

In such a cartridge system, a main body electrode portion of the main body of the image forming apparatus and an electrical contact portion of the process cartridge are brought into contact with each other in a state where the cartridge is mounted onto the main body of the electrophotographic image forming apparatus. Accordingly, units to be conducted such as the electrophotographic photosensitive drum and the process unit are electrically connected with the main body of the image forming apparatus. Accordingly, process steps such as charging of the photosensitive drum and development with a developer bearing member, ground connection of the electrophotographic photosensitive drum, detection of a remaining toner amount with electrostatic capacitance, and the like become possible.

Here, as an example of the electrical contact portion of the process cartridge, a method for injecting a conductive resin into a gap between a frame of the cartridge and a mold closely attached to the frame and releasing the mold to form the electrical contact portion integrally with the frame is known (for example, Japanese Patent Application Laid-Open No. 2012-63750).

SUMMARY OF THE INVENTION

According to an aspect of the present invention, a cartridge attachable to and detachable from a main body of an image forming apparatus, includes a process unit configured to perform image formation, a frame configured to support the process unit, and a conductive member injection-molded integrally with the frame using a conductive resin, configured to be in contact with a main body electrode portion provided in the main body of the image forming apparatus, and to be electrically connected with the process unit, wherein an electrode portion of the conductive member is configured to be connected with the main body electrode portion, and include a plurality of protruded portions.

According to an aspect of the present invention, a cartridge attachable to and detachable from a main body of an image forming apparatus, includes a frame configured to store developer, a member provided on the frame, and a conductive member injection-molded integrally with the frame using a conductive resin, configured to be in contact with a main body electrode portion provided in the main body of the image forming apparatus, and to be electrically connected with the member, wherein an electrode portion of the conductive member is configured to be connected with the main body electrode portion, and include a plurality of protruded portions.

Further features of the present invention will become apparent from the following description of exemplary embodiments with reference to the attached drawings.

DESCRIPTION OF THE EMBODIMENTS

Exemplary embodiments for implementing the present invention will be described in detail with reference to the drawings. Note that dimensions, materials, shapes, and relative arrangement of constituent parts described in the exemplary embodiments should be appropriately changed according to a configuration of a device to which the invention is applied, and various conditions, and are not intended to limit the scope of the invention to the exemplary embodiments below. In addition, a longitudinal direction N in the description below means an axial direction of a developer bearing member, i.e., a developing roller, and an image bearing member, i.e., a photosensitive drum.

General Schematic Configuration of Image Forming Apparatus (Overall Configuration of Image Forming Apparatus)

Figure 2A:
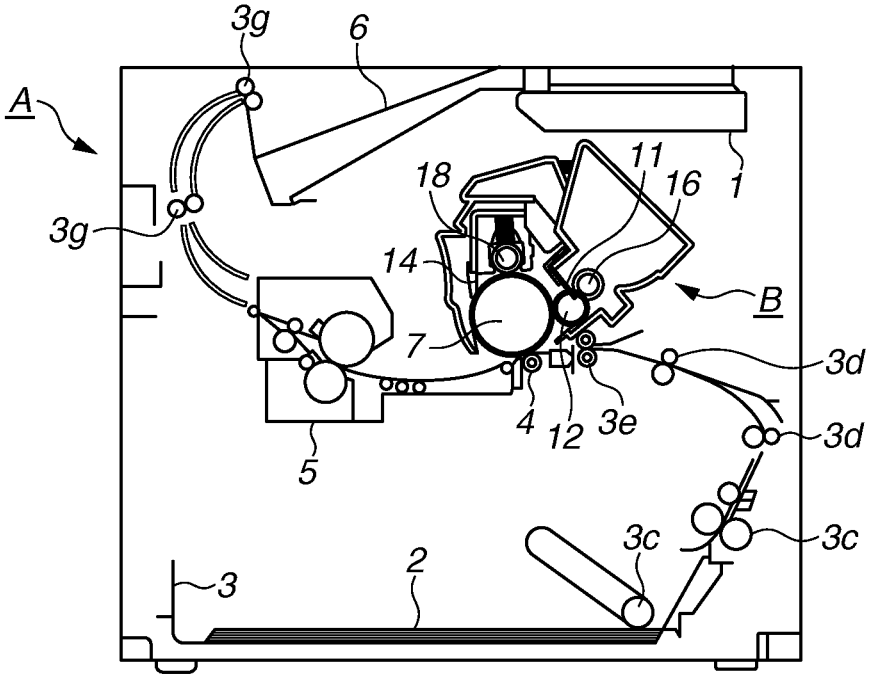
FIGS. 2A and 2B are cross-sectional views of the image forming apparatus and the cartridge according to the first exemplary embodiment.

First, a general outline of a main body of an image forming apparatus A according to a first exemplary embodiment will be described below with reference to FIG. 2A. As illustrated in FIG. 2A, a detachable process cartridge B is mounted in the main body. Herein, the process cartridge is formed in such a manner that a photosensitive drum as an image bearing member, and a process unit that acts on the photosensitive drum are integrally formed into a cartridge, and are detachably attached to the main body of the image forming apparatus A.

In the cartridge B, a rotatable photosensitive drum 7, and the process unit including a charging roller 18, a developing roller 12, a developing blade 11, and a cleaning blade 14 around the photosensitive drum 7 are integrally provided. The charging roller 18 is a charging member, and uniformly charges a surface of the photosensitive drum 7. The developing blade 11 is a developer restricting member to restrict the thickness of toner (developer) adhering to the developing roller 12 to be uniform. The developing roller 12 is a developer bearing member, and develops a latent image formed on the photosensitive drum 7 to a visible image with the toner. The cleaning blade 14 removes the toner remaining on the photosensitive drum 7 after the toner image formed on the photosensitive drum 7 is transferred onto a recording medium. Further, an exposure device 1 is provided above the cartridge B. The exposure device 1 selectively exposes the photosensitive drum 7, based on image information, and forms the latent image on the photosensitive drum 7.

A cassette 3 is mounted in a lower part of the image forming apparatus A. The cassette 3 contains recording materials 2 (e.g., sheets of paper). Further, a recording medium conveyance unit is provided so as to convey the recording material 2 through a transfer roller 4 and a fixing device 5 toward an upper part of the main body. More specifically, a feed roller 3*c* that separates and feeds the recording material 2 stored in the cassette 3 one by one, a conveyance roller pair 3*d* that conveys the fed recording material 2, and a registration roller pair 3*e* that synchronizes the latent image formed on the photosensitive drum 7 and the recording material 2 are provided. Then, the fixing device 5 that fixes the image formed on the recording material 2 is provided.

At the time of image forming, the photosensitive drum 7 is rotated, and the exposure device 1 selectively exposes the photosensitive drum 7 that has been uniformly charged by the charging roller 18 to form an electrostatic latent image on the photosensitive drum 7. The developing roller 12 develops the latent image to form a toner image on the photosensitive drum 7. Then, the registration roller pair 3*e* conveys the recording material 2 to between the photosensitive drum 7 and the transfer roller 4, in synchronization with the image formation, and applies a voltage to the transfer roller 4 to transfer the toner image onto the recording material 2. Accordingly, an image is formed on the recording material 2. The recording material 2, on which the image is formed, is heated and pressurized by the fixing device 5, so that the toner image is fixed thereon. Following that, the recording material 2 is discharged to a discharge unit 6 with a discharge roller 3*g*.

(General Outline of Cartridge)

Figure 2B:
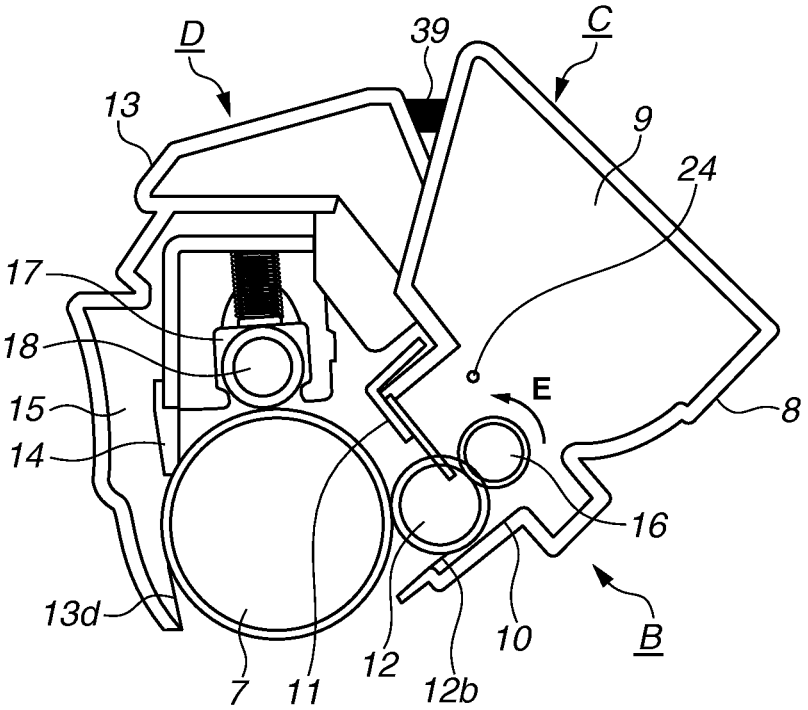

Next, a general outline of the cartridge B will be described referring to FIG. 2B. FIG. 2B is a cross-sectional view of the cartridge B in which the toner is stored.

The cartridge B includes a developing unit C and a drum unit D. The developing unit C includes the developing roller 12, a toner supply roller 16, the developing blade 11, a spill prevention sheet 12*b*, and a developing frame 8. In the developing unit C, the toner supply roller 16, the developing blade 11, and the spill prevention sheet 12*b* are arranged around the developing roller 12 that is a rotating body. Accordingly, the toner supply roller 16 that is a developer feed member is in contact with the developing roller 12 and is rotated in the arrow E direction, fixes the toner stored in a toner storage portion 9 onto the developing roller 12, and sends toner fixed on the developing roller 12 to a developing chamber 10. Then, the developing blade 11 restricts a toner layer on the developing roller 12 to have a restricted thickness to form a uniform toner layer (developer layer) on a surface of the developing roller 12. In this way, the developing roller 12 can develop the latent image formed on the photosensitive drum 7. The spill prevention sheet 12*b* is fixed to the developing frame 8 to be in contact with the developing roller 12 to prevent the toner stored in the toner storage portion 9 from leaking from between the developing roller 12 and the developing frame 8. The developing blade 11 is formed of an elastic member made of a metal thin sheet or the like, and is fixed to the developing frame 8. In the present exemplary embodiment, the developing blade 11 includes a blade and a supporting portion such as a sheet metal that fixes the blade.

Further, the drum unit D includes the photosensitive drum 7, the charging roller 18, the cleaning blade 14, a scoop sheet 13*d*, and a drum frame 13. The charging roller 18, the cleaning blade 14, and the scoop sheet 13*d* are arranged around the photosensitive drum 7 that is a rotating body. The cleaning blade 14 is fixed to the drum frame 13 to be in contact with the surface of the photosensitive drum 7 in a state of being tilted from a normal line of the photosensitive drum 7 to a rotating direction of the photosensitive drum 7. Accordingly, after the toner image on the photosensitive drum 7 is transferred onto the recording material 2 by the transfer roller 4, the toner remaining on the photosensitive drum 7 is scraped by the cleaning blade 14, and a residual toner is collected (removed) to a waste toner storage portion 15 of the drum frame 13. Then, the surface of the photosensitive drum 7 is uniformly charged by the charging roller 18 serving as a charging device (process unit), and becomes being able to form the latent image by the exposure device 1. The scoop sheet 13*d* is fixed to the drum frame 13 to be in contact with the photosensitive drum 7 to prevent the waste toner in the waste toner storage portion 15 from leaking from between the drum frame 13 and the photosensitive drum 7. The cleaning blade 14 is formed of an elastic member such as rubber, and is fixed to the drum frame 13. In the present exemplary embodiment, the cleaning blade 14 includes a blade and a supporting portion such as a sheet metal that fixes the blade.

As the above configuration, driving force is transmitted from the main body of the image forming apparatus A to the drum unit D to drive and rotate the photosensitive drum 7 according to an image forming operation. The charging roller 18 is rotatably attached to the drum unit D, and is pressurized toward the photosensitive drum 7 and is driven and rotated with the photosensitive drum 7.

(Specific Configuration of Drum Unit)

Figure 3:
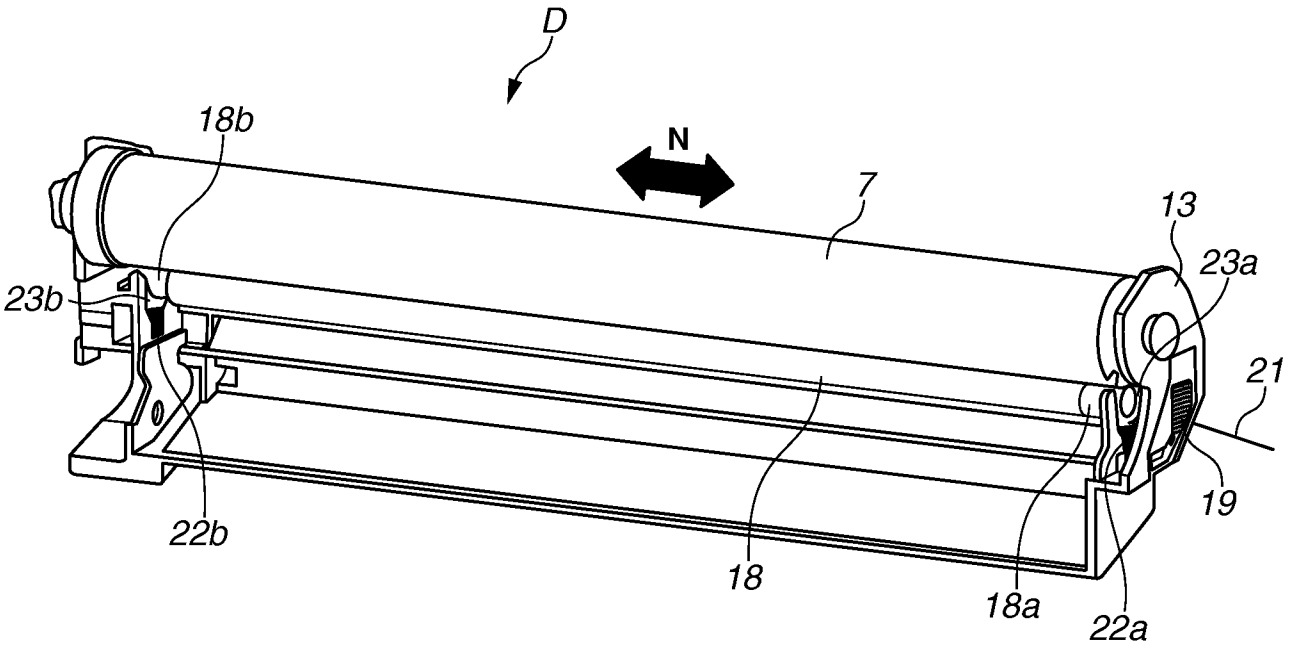
FIG. 3 is an overall view of a drum unit according to the first exemplary embodiment.
Figure 4A:
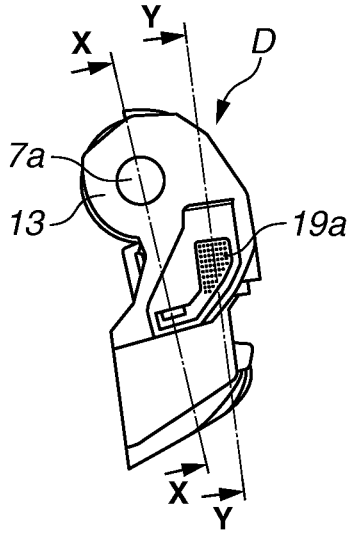
FIGS. 4A to 4C are diagrams each illustrating an end of the drum unit according to the first exemplary embodiment.
Figure 4B:
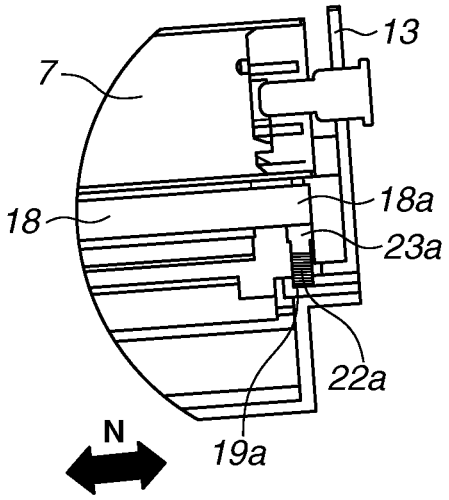
Figure 4C:
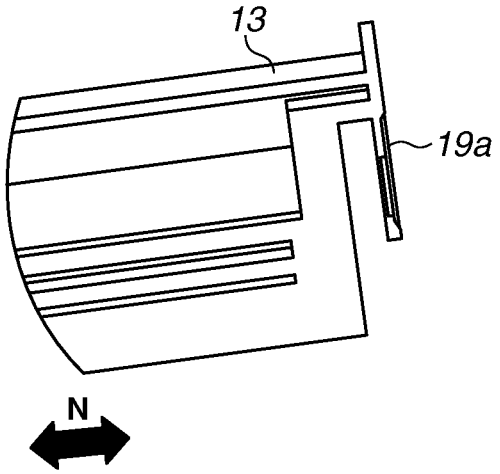
Figure 5:
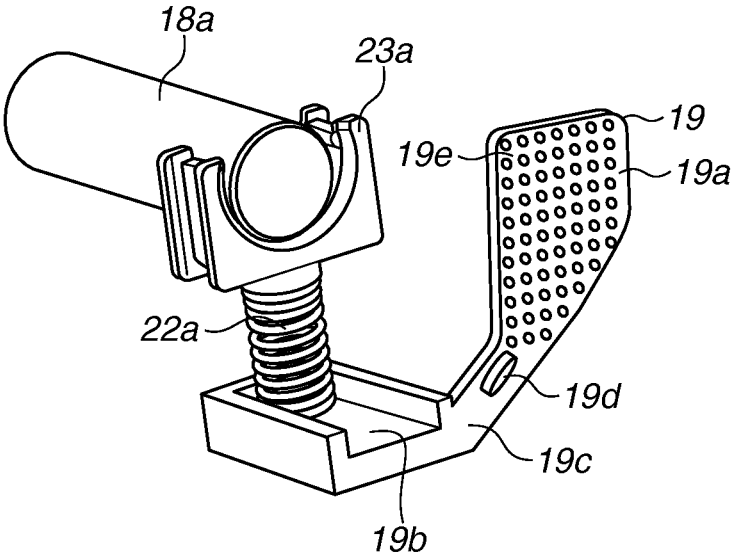
FIG. 5 is a diagram illustrating a configuration of the drum unit according to the first exemplary embodiment.

A schematic configuration of the drum unit D will be described with reference to FIGS. 2B, and 3 to 5. FIG. 3 is a configuration diagram of a portion relating to a charging process of the drum unit D in a state where the cartridge B is mounted in the main body of the image forming apparatus A. FIG. 4A is a side view illustrating an end including a conductive member 19, in the longitudinal direction N of the drum unit D in FIG. 3. FIGS. 4B and 4C are an X-X cross-sectional view and a Y-Y cross-sectional view of FIG. 4A, respectively. FIG. 5 is a diagram illustrating electrical connection of the main body of the image forming apparatus A and the cartridge B.

As illustrated in FIG. 3, the charging roller 18 for charging the surface of the photosensitive drum 7 has both end portions 18*a* and 18*b* of an axis thereof rotatably supported by charging roller terminal portions 23*a* and 23*b* made of a conductive material (for example, a conductive resin). The charging roller terminal portions 23*a* and 23*b* are attached to the drum frame 13 in a state where compression springs 22*a* and 22*b* can press them. In this way, the charging roller 18 is supported by the drum frame 13. More specifically, as illustrated in FIGS. 4A to 4C, in one end including the conductive member 19 of the longitudinal direction N of the drum unit D, one end of the compression spring 22*a* is in contact with the charging roller terminal portion 23*a* that supports the end portion 18*a* of the axis of the charging roller 18. In this way, the charging roller 18 and the compression spring 22*a* are in an electrically connectable state. Further, the other end of the compression spring 22*a* is in contact with a contact portion 19*b* that is a first contact portion of the conductive member 19 supported by the drum frame 13, so that the compression spring 22*a* and the contact portion 19*b* are in an electrically connectable state. In this way, when the photosensitive drum 7 and the charging roller 18 come in contact with each other, the compression springs 22*a* and 22*b* are compressed, and the charging roller 18 is pressed to the photosensitive drum 7 with a predetermined pressure by spring force caused at this time. In the present exemplary embodiment, the conductive compression springs 22*a* and 22*b* made of metal are used as an urging unit. However, the urging unit is not limited thereto. Any urging unit may be employed as long as the urging unit can electrically connect at least one of the charging roller terminal portions 23*a* and 23*b* with the conductive member 19, and can press the charging roller 18 to the photosensitive drum 7.

Figure 1:
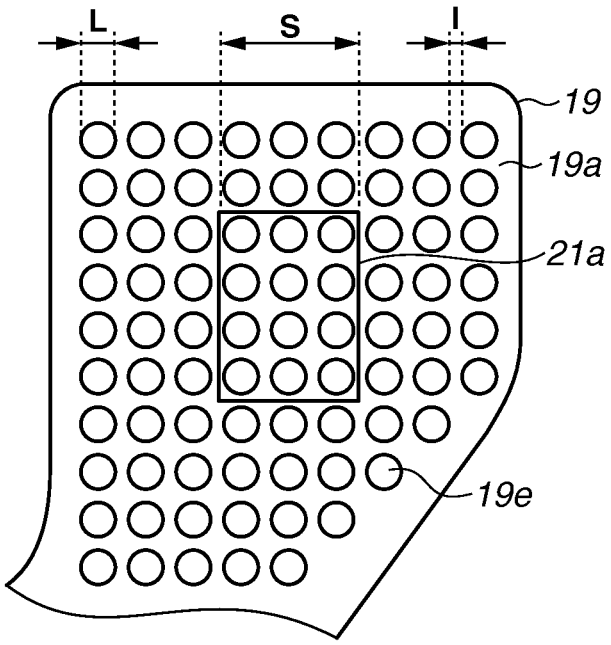
FIG. 1 is a diagram illustrating a contact state of an electrode portion of a cartridge and a main body electrode portion of an image forming apparatus according to a first exemplary embodiment.

Here, a configuration of the conductive member 19 will be described in more detail. The conductive member 19 is integrally molded to the drum frame 13, as illustrated in FIG. 3. The conductive member 19 includes an electrode portion 19*a* as a second contact portion, the contact portion 19*b* as the first contact portion, a connection portion 19*c*, and a gate portion 19*d*. The electrode portion 19*a* and the contact portion 19*b* are integrally molded to be connected at the connection portion 19*c*. The contact portion 19*b* is formed into a shape having a depressed portion surrounded by the other end side of the longitudinal direction N and two sides intersecting with the longitudinal direction N. Further, a plurality of protruded portions 19*e* is formed on a surface layer of the electrode portion 19*a* exposed from the drum frame 13 in the longitudinal direction N. More specific, as illustrated in FIG. 1, the plurality of protruded portions 19*e* provided on the electrode portion 19*a* comes in contact with a flat surface 21*a* of a main body electrode portion 21 of the image forming apparatus A when the cartridge B is mounted onto the main body of the image forming apparatus A, as illustrated in FIG. 3. At this time, the electrode portion 19*a* is connected with the main body electrode portion 21 through the plurality of protruded portions 19*e*. Therefore, at the time image forming, after the process cartridge B is mounted in the image forming apparatus A, a current is generated in the main body electrode portion 21 according to a command from a controller (not illustrated) of the main body of the image forming apparatus A, and a voltage is applied. Then, the current flows via contact portions of the main body electrode portion 21 and the plurality of protruded portions 19*e* provided on the electrode portion 19*a*. Then, the current flowing from the main body electrode portion 21 is transferred to the charging roller 18 through the electrode portion 19*a*, the connection portion 19*c*, the contact portion 19*b*, the compression spring 22*a*, the charging roller terminal portion 23*a* made of a conductive resin, and the axis 18*a*, and a voltage is applied to a surface of the charging roller 18. Then, the surface of the photosensitive drum 7 is uniformly charged by the charging roller 18. As described above, the conductive member 19 is provided to electrically connect the charging roller 18 and the main body electrode portion 21.

In the present exemplary embodiment, as the conductive member 19, polyacetal (POM) containing about 10% of carbon black has been used. However, a base material resin of the conductive member 19 is not limited to polyacetal, and a thermosetting resin or a thermoplastic resin that can be subjected to injection molding can be used. More specifically, as the base material resin of the conductive member 19, a resin such as polyamide (PA), polyethylene (PE), polypropylene (PP), or polyethylene terephthalate (PET) can be used. Then, a conductive material of carbon fiber, or particles or fiber of another metal is dispersed on the base material resin, so that the conductive member 19 having electrical conduction characteristics is obtained. In the present exemplary embodiment, to decrease damage to a production apparatus due to friction and the like as much as possible, carbon black has been used. "Having electrical conduction characteristics" means that electrical conductivity by a measuring method defined in JIS K 7194 is 30 Ω·cm or less, and "having no electrical conduction characteristics" means the electrical conductivity is larger than 30 Ω·cm.

Further, in the present exemplary embodiment, the conductive member 19 and the charging roller 18 are electrically connected through the charging roller terminal portion 23*a* and the compression spring 22*a*. However, the conductive member 19 and the charging roller 18 may be directly connected.

Figure 6:
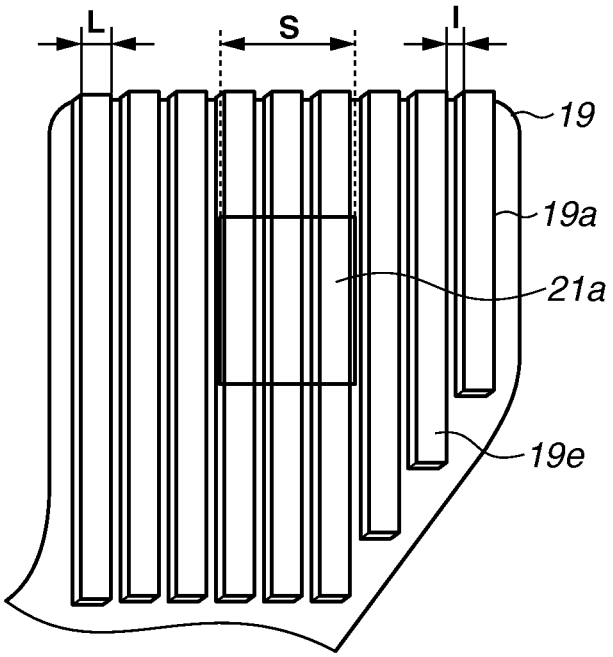
FIG. 6 is a diagram illustrating a modification of the first exemplary embodiment.

Further, to cause the electrode portion 19*a* to have multipoint contact with the flat main body electrode portion 21, various shapes can be used, in addition to the configuration in which the plurality of protruded portions 19*e* is regularly arranged, as illustrated in the above-described exemplary embodiment. For example, a multipoint contact configuration can be employed according to the shape and the size of the main body electrode portion 21. For example, a configuration in which the electrode portion 19*a* is embossed, a configuration in which a plurality of linear protruded portions is provided, as illustrated in FIG. 6, a configuration in which lattice-shaped protruded portions are provided, or the like may be employed. However, the protruded portion 19*e* is at least formed to be larger than the particle diameter or the thickness of the conductive material of carbon fiber, or metal particles or fiber, and to include the conductive material therein. To include as much conductive material as possible in the protruded portion 19*e*, the length of the protruded portion 19*e* is desirably 100 μm or longer in a direction perpendicular to a protruding direction into which the protruded portion 19*e* is protruded from the electrode portion 19*a*, i.e., in an extending direction of the electrode portion 19*a*. Further, the length of the protruded portion 19*e* in the extending direction of the electrode portion 19*a* is desirably formed longer than the length of the protruded portion 19*e* in the protruding direction of the protruded portion 19*e*.

Figure 7A:
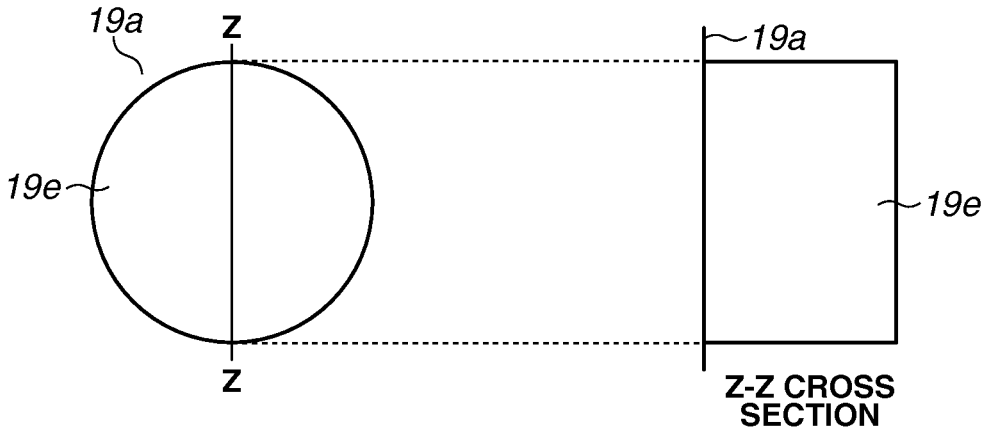
FIGS. 7A and 7B are a plan view and a cross-sectional view illustrating a modification of the first exemplary embodiment.
Figure 7B:
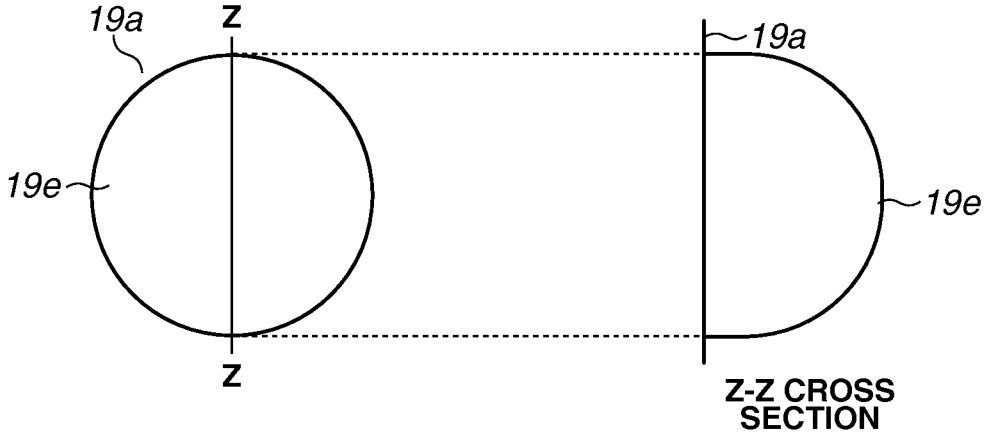

In addition, a cross-sectional shape of the protruded portion 19*e* on a surface intersecting with the protruding direction into which the protruded portion 19*e* is protruded from the electrode portion 19*a* has desirably no corners. More specifically, as illustrated in FIG. 7A, the protruded portion 19*e* desirably has a columnar shape, in which a Z-Z cross section in the protruding direction is a rectangle, and a cross-sectional shape intersecting with the protruding direction is a circle. More desirably, as illustrated in FIG. 7B, the protruded portion 19*e* has a columnar shape, in which the Z-Z cross section in the protruding direction has a dome shape with a curved surface at a tip end side of the protruding direction, and the cross-sectional shape intersecting with the protruding direction is a circle. Further, as illustrated in FIG. 1, the main body electrode portion 21 has the flat surface 21*a* facing the electrode portion 19*a*, and a size S of the flat surface 21*a* is desirably larger than a width L of the protruded portion 19*e*, and a distance I between the plurality of protruded portions 19*e*.

Effect of Present Exemplary Embodiment

In the above configuration, the electrode portion 19*a* is connected with the main body electrode portion 21 through the plurality of protruded portions 19*e*. Accordingly, a contact area between the protruded portions 19*e* and the main body electrode portion 21 becomes smaller so as to concentrates the contact pressure force without increasing the contact pressure between the main body electrode portion 21 and the protruded portions 19*e*, and the contact pressure as low pressure at which deformation does not occur in the cartridge B, the cartridge B and the image forming apparatus A can be conducted. In other words, it is not necessary to make the urging force of the main body electrode portion 21 to the cartridge B strong to stabilize the conduction between the electrical contact portion of the cartridge B made of a conductive resin, and the main body electrode portion 21 of the main body of the image forming apparatus A. Therefore, the conduction between the electrode portion 19*a* of the cartridge B and the main body of the image forming apparatus A can be more reliably secured while improving the downsizing of the cartridge B, without causing the frame 13 of the cartridge B to have sufficient strength to suppress the deformation. In addition, the electrode portion 19*a* is electrically connected with the main body electrode portion 21 through the plurality of protruded portions 19*e*, whereby the cartridge B and the image forming apparatus A can be more desirably conducted even if the conductive member 19 is formed of a conductive resin in which the conductive material is non-uniformly dispersed.

Further, in the present exemplary embodiment, the plurality of protruded portions 19*e* is provided on the conductive member 19 made of a conductive resin. Therefore, the conductive resin can be suppressed from being scraped largely, which is caused when the main body electrode portion 21 made of metal and the electrode portion 19*a* are brought into contact with each other. Accordingly, an influence on an image, which is caused when powder of the conductive resin and the like adhere to the photosensitive drum, can be suppressed. Further, the protruded portion 19*e* is the columnar protruded portion without corners, and is the semicircular protruded portion without having protruding ridgeline, whereby the conductive resin that forms the conductive member 19 can be suppressed from being scraped largely. The size S of the flat surface 21*a* provided on the main body electrode portion 21 facing the electrode portion 19*a* is made larger than the width L of the protruded portion 19*e*, and the distance I between the plurality of protruded portions 19*e*, whereby the conductive resin can be more desirably prevented from being scraped, and thus it is favorable.

(Method for Manufacturing Drum Unit)

Figure 8A:
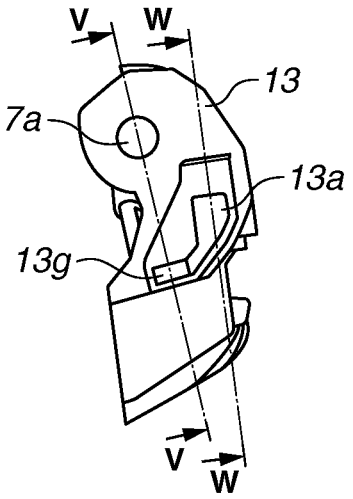
FIGS. 8A to 8C are configuration diagrams of a drum frame used in the drum unit according to the first exemplary embodiment.
Figure 8B:
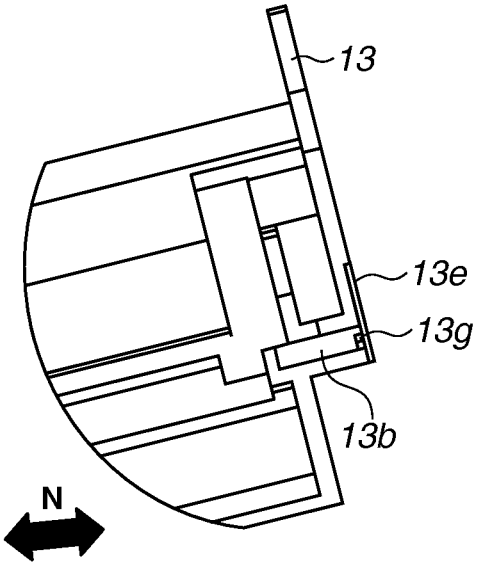
Figure 8C:
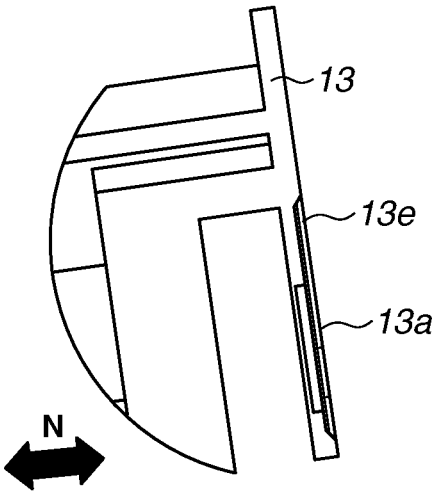

FIGS. 8A to 8C are diagrams illustrating a shape of the drum frame 13 before the conductive resin is injected.

FIG. 8A is a side view of one end of the longitudinal direction N, of the drum frame 13, and FIGS. 8B and 8C are a V-V cross-sectional view and a W-W cross-sectional view of FIG. 8A, respectively.

First, an electrode portion forming portion 13*a* where the electrode portion 19*a* is formed, a contact portion forming portion 13*b* where the contact portion 19*b* is formed, a connection portion forming portion 13*c* where the connection portion 19*c* is formed, and the drum frame 13 having an insertion slot 13*g* are prepared. The electrode portion forming portion 13*a* is provided to have a space connected with an external environment at one end of the longitudinal direction N, on a surface intersecting with the longitudinal direction N. Further, the contact portion forming portion 13*b* includes a space intersecting with the V-V line that passes through an axis 7*a* of the photosensitive drum 7, and extending in the longitudinal direction N. Further, the connection portion forming portion 13*c* is provided to become a space that connects the spaces of the electrode portion forming portion 13*a* and the contact portion forming portion 13*b*.

Figure 9:
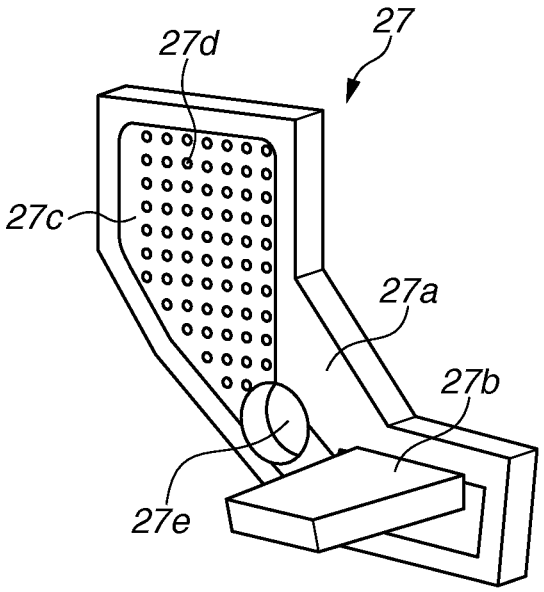
FIG. 9 is a diagram illustrating a mold used for forming the drum unit according to the first exemplary embodiment.

Then, a mold 27 illustrated in FIG. 9 is prepared. The mold 27 includes a contact surface 27*a*, a protrusion 27*b*, an electrode portion forming portion 27*c*, and an injection port 27*e*. The contact surface 27*a* is a surface that comes in contact with a surface of one end side of the longitudinal direction N, of the drum frame 13. The protrusion 27*b* is a portion inserted into the drum frame 13 where the contact portion 19*b* is formed. The electrode portion forming portion 27*c* is a portion where the electrode portion 19*a* is formed, and includes a plurality of depressed portions 27*d* where the plurality of protruded portions 19*e* is formed, on a surface. Then, the injection port 27*e* is a through-hole for allowing a molten resin having electrical conduction characteristics to be injected into, and is a portion into which a gate 30 is inserted.

Figure 10A:
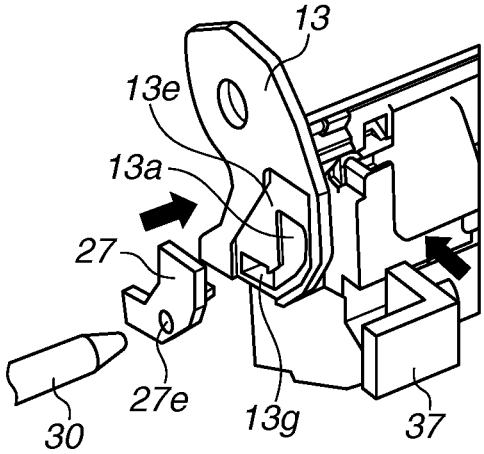
FIGS. 10A to 10C are diagrams illustrating a process of the drum unit according to the first exemplary embodiment.

Next, as illustrated in FIG. 10A, the contact surface 27*a* of the mold 27 is brought into contact with a surface of one end side of the longitudinal direction N, of the drum frame 13, from one end to the other end side of the longitudinal direction N of the drum frame 13, and is fixed to be closely attached to the drum frame 13. At this time, the mold 27 is arranged to the drum frame 13 in a state where the protrusion 27*b* is inserted into the insertion slot 13*g*, and a surface of the protrusion 27*b* at the axis side of the photosensitive drum 7 comes in contact with the drum frame 13.

Figure 10B:
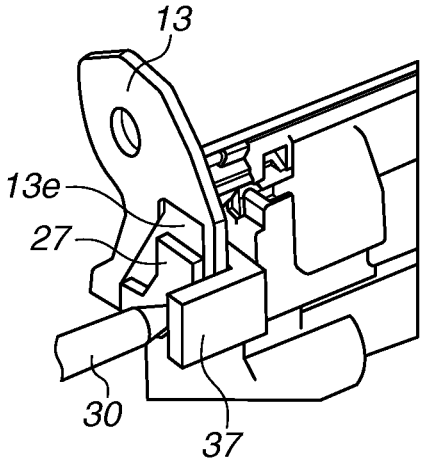

Then, as illustrated in FIG. 10B, the gate 30 that injects the conductive resin is brought into contact with the injection port 27*e*, and the conductive resin is injected into a space formed between the drum frame 13 and the mold 27, so that the conductive member 19 is integrally formed with the drum frame 13. More specifically, the conductive resin injected into the drum frame 13 through the injection port 27*e* fills the spaces of the electrode portion forming portion 13*a* and the contact portion forming portion 13*b* from the gate portion 19*d* through the connection portion forming portion 13*c*. Accordingly, the electrode portion 19*a*, the contact portion 19*b*, and the connection portion 19*c* are formed. Further, in the electrode portion forming portion 13*a*, the molten resin flows into the plurality of depressed portions 27*d*, so that the plurality of protruded portions 19*e* is formed. Further, in the connection portion forming portion 13*c*, the resin is injected to surround a periphery of the protrusion 27*b*, so that the shape having a depressed portion surrounded by the other end side of the longitudinal direction N and two sides intersecting with the longitudinal direction N is formed.

Figure 10C:
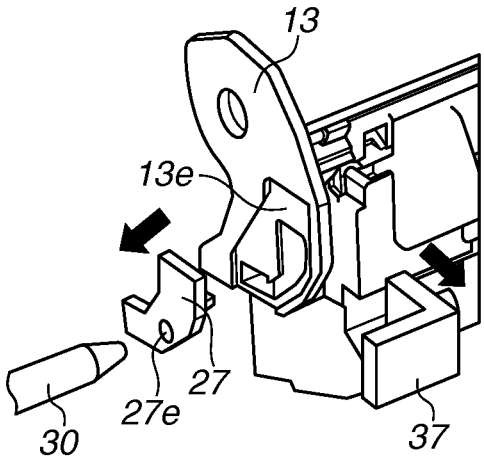

As illustrated in FIG. 10C, after the injection of the molten resin is completed, the mold is released, so that the conductive member 19 integrally injection-molded to the drum frame 13 is completed.

When the contact surface 27*a* of the mold 27 is brought into contact with a contact surface 13*e* of the drum frame 13 and the mold is closed at the time of the injection of the conductive resin, it is favorable to use a backup 37. The backup 37 supports a back side of the contact surface 13*e* of the drum frame 13, so that pressure applied to closely attach the mold 27 to the drum frame 13, and deformation of the drum frame 13 due to resin pressure at the time of injection of the resin can be suppressed.

Further, after the compression springs 22*a* and 22*b*, the charging roller terminal portions 23*a* and 23*b*, and the charging roller 18 are arranged in the drum frame 13 to which the conductive member 19 is integrally formed, the photosensitive drum 7 is fixed to a bearing of the drum frame 13. Then, the cleaning blade 14 and the scoop sheet 13*d* are fixed to the drum frame 13, so that the drum unit D is completed.

Other Exemplary Embodiment

In the first exemplary embodiment, a case of applying the conductive member 19 to the charging process of the photosensitive drum 7 has been described. However, it is not limited thereto.

Figure 11A:
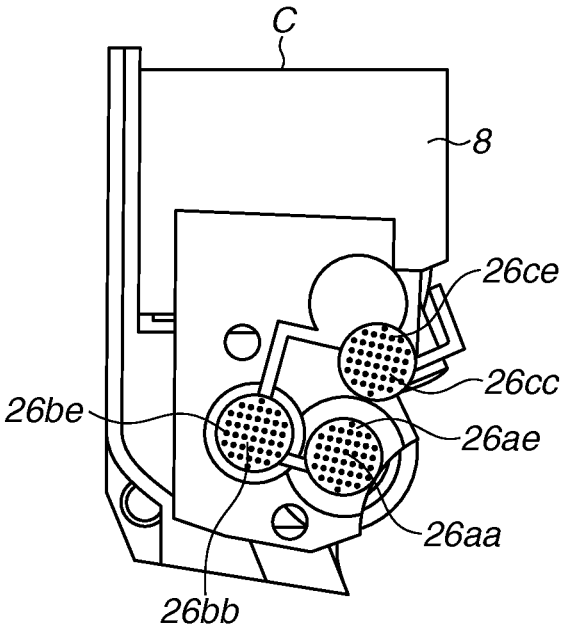
FIGS. 11A and 11B are diagrams illustrating a configuration of a cartridge according to another exemplary embodiment.
Figure 11B:
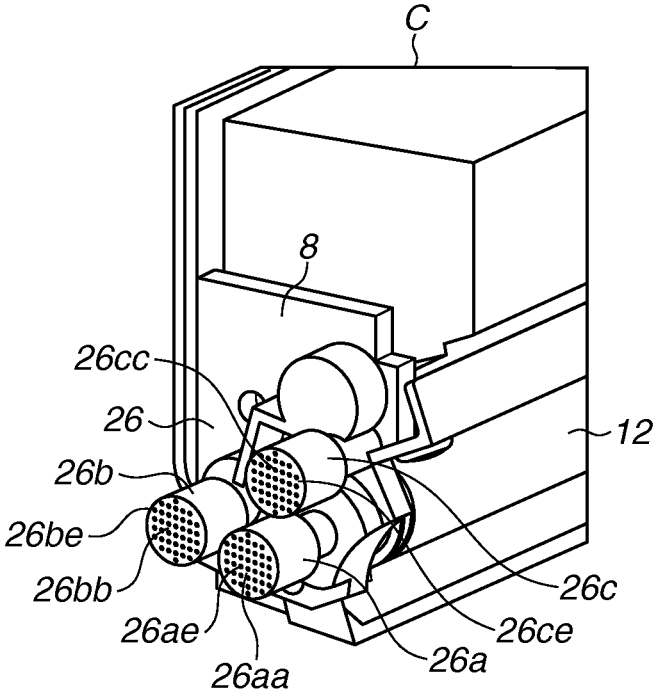

For example, as illustrated in FIGS. 2B, 11A, and 11B, the present invention can be applied to a case where a portion electrically conducted with a developing roller 12, a toner supply roller 16, and a developing blade 11 of a developing unit C, and being in contact with and electrically connected with a main body electrode portion 21 is formed of a conductive resin. In this case, a conductive member 26*a* to be conducted with the developing roller 12, a conductive member 26*b* to be conducted with the toner supply roller 16, and a conductive member 26*c* to be conducted with the developing blade 11 are formed.

In this configuration, a plurality of protruded portions 26*ae*, 26*be*, and 26*ce* is provided on electrode portions 26*aa*, 26*bb*, and 26*cc* of the conductive members 26*a*, 26*b*, and 26*c* with which the main body electrode portion 21 for a developing unit is in contact. However, when one unit has the plurality of electrode portions in this way, the protruded portions 26*ae*, 26*be*, and 26*ce* may be provided only at necessary portions. With this configuration, the developing roller 12 is electrically connected with the main body electrode portion 21 through the conductive member 26*a* in a stable manner, whereby occurring of failure in development of a latent image formed on a photosensitive drum 7 can be suppressed. Further, the toner supply roller 16 is electrically connected with the main body electrode portion 21 through the conductive member 26*b* in a stable manner, whereby a toner stored in a toner storage portion 9 can be firmly fixed on the developing roller 12. Further, the developing blade 11 is electrically connected with the main body electrode portion 21 through the conductive member 26*c*, whereby a more uniform toner layer can be formed on a surface of the developing roller 12.

Similarly to the first exemplary embodiment, the conductive members 26*a*, 26*b*, and 26*c* of the developing unit C can be formed in such a manner that a mold is brought into contact with a developing frame 8, and is injection-molded.

In the present exemplary embodiment, the plurality of protruded portions 26*ae*, 26*be*, and 26*ce* is formed on the electrode portions 26*aa*, 26*bb*, and 26*cc*, whereby a cartridge B and an image forming apparatus A can be conducted with a low contact pressure that does not cause deformation of the cartridge B, similar to the first exemplary embodiment. Further, the electrode portions 26*aa*, 26*bb*, and 26*cc* are electrically connected with the main body electrode portion 21 through the protruded portions 26*ae*, 26*be*, and 26*ce*, whereby the cartridge B and the image forming apparatus A can be more desirably conducted even if the conductive members 26*a*, 26*b*, and 26*c* are formed of a conductive resin in which a conductive material is non-uniformly dispersed.

In the present exemplary embodiment, cross-sectional shapes of the protruded portions 26*ae*, 26*be*, and 26*ce* on surfaces intersecting with a protruding direction from the electrode portions 26*aa*, 26*bb*, and 26*cc* have desirably no corners. More specifically, similarly to the protruded portion 19*e* of FIG. 7A, the protruded portions 26*ae*, 26*be*, and 26*ce* are desirably columnar protruded portions. Further, similarly to the protruded portion 19*e* of FIG. 7B, the protruded portions 26*ae*, 26*be*, and 26*ce* are desirably dome-shaped protruded portions. Further, when the main body electrode portion 21 is formed of metal, a flat surface facing the electrode portions 26*aa*, 26*bb*, and 26*cc* is provided on the main body electrode portion 21, and the flat surface is desirably made larger than widths of the protruded portions 26*ae*, 26*be*, and 26*ce*. Further, the flat surface is desirably made larger than distances between the plurality of protruded portions 26*ae*, the plurality of protruded portions 26*be*, and the plurality of protruded portions 26*ce*.

Other than the above, the present invention can be applied to a case where a portion conducted with a detection member 24 provided inside a toner storage portion 9, being in contact with the main body electrode portion 21 and electrically connected with a detection circuit of a remaining toner amount is formed of the conductive resin. In this case, the detection circuit of the remaining toner amount can be electrically connected with the detection member 24 provided inside the toner storage portion 9 through the conducive member in a stable manner, and electrostatic capacitance, which is changed according to the amount of toner, can be more accurately measured. As a result, the remaining toner amount in the toner storage portion 9 can be more accurately detected.

Further, the present invention can be applied to a configuration in which electrical connection such as a process for supplying power to the developing roller 12, a process for supplying power to the toner supply roller 16, or grounding (not illustrated) of the photosensitive drum 7 is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-148108, filed Jul. 18, 2014, which is hereby incorporated by reference herein in its entirety.

What is claimed is:

1. A cartridge attachable to and detachable from a main body of an image forming apparatus, the cartridge comprising:

a process unit configured to perform image formation;

a frame configured to support the process unit; and a conductive member injection-molded integrally with the frame using a conductive resin, configured to be in contact with a main body electrode portion provided in the main body of the image forming apparatus, and to be electrically connected with the process unit, wherein an electrode portion of the conductive member is configured to be connected with the main body electrode portion, and include a plurality of protruded portions, and wherein the main body electrode portion includes a flat surface facing the electrode portion, and the flat surface is larger than the protruded portion, and a distance between the plurality of protruded portions.

2. The cartridge according to claim 1, wherein the process unit is a charging member configured to contact with an image bearing member to charge the image bearing member.

3. The cartridge according to claim 2, wherein the conductive member includes the electrode portion and a contact portion configured to supply current to the charging member, and a spring having electrical conductivity is arranged between the charging member and the contact portion.

4. The cartridge according to claim 1, wherein the protruded portion is a protruded portion without having a corner in a cross-sectional shape on a surface intersecting with a protruding direction into which the protruded portion is protruded from the electrode portion.

5. The cartridge according to claim 1, wherein the protruded portion is a linear protruded portion.

6. The cartridge according to claim 1, wherein the main body electrode portion is made of metal.

7. An image forming apparatus to which the cartridge according to claim 1 is detachably attached.

8. The image forming apparatus according to claim 7, wherein the main body electrode portion is made of metal.

9. A cartridge attachable to and detachable from a main body of an image forming apparatus, the cartridge comprising:

a frame configured to store developer;

a member provided on the frame; and a conductive member injection-molded integrally with the frame using a conductive resin, configured to be in contact with a main body electrode portion provided in the main body of the image forming apparatus, and to be electrically connected with the member, wherein an electrode portion of the conductive member is configured to be connected with the main body electrode portion, and include a plurality of protruded portions, and wherein the main body electrode portion includes a flat surface facing the electrode portion, and the flat surface is larger than the protruded portion, and a distance between the plurality of protruded portions.

10. The cartridge according to claim 9, wherein the member is a restricting member configured to contact with a developer bearing member to form a developer layer on the developer bearing member.

11. The cartridge according to claim 9, wherein the member is a feed member configured to supply the developer to the developer bearing member.

12. The cartridge according to claim 9, wherein the member is a detection member configured to detect an amount of the developer stored in the frame.

13. The cartridge according to claim 9, wherein the protruded portion is a protruded portion without having a corner in a cross-sectional shape on a surface intersecting with a protruding direction into which the protruded portion is protruded from the electrode portion.

14. The cartridge according to claim 9, wherein the protruded portion is a linear protruded portion.

15. The cartridge according to claim 9, wherein the main body electrode portion is made of metal.

16. An image forming apparatus to which the cartridge according to claim 9 is detachably attached, wherein the main body electrode portion is made of metal.

* * * * *